US005662398A

United States Patent [19]

Swallow

[11] Patent Number: 5,662,398

[45] Date of Patent: Sep. 2, 1997

[54] CORNER CABINET DRAWER ASSEMBLY

[76] Inventor: Clarence Swallow, 3800 McDowell Creek Rd., Manhatten, Kans. 66502

[21] Appl. No.: 647,235

[22] Filed: May 9, 1996

[51] Int. Cl.[6] ..... A47B 81/00

[52] U.S. Cl. ..... 312/238; 312/295

[58] Field of Search ..... 312/248, 295

[56] References Cited

U.S. PATENT DOCUMENTS

| | | |
|---|---|---|
| 799,253 | 9/1905 | Nichols . |
| 1,764,229 | 6/1930 | Smith . |
| 2,386,092 | 10/1945 | Cornish . |
| 2,627,863 | 2/1953 | Cavicchioli . |
| 2,678,866 | 5/1954 | Merrett . |
| 2,703,267 | 3/1955 | Purdy . |
| 2,941,659 | 6/1960 | Thrower et al. . |
| 4,582,372 | 4/1986 | Cooper . |

FOREIGN PATENT DOCUMENTS

| | | | |
|---|---|---|---|
| 5146325 | 6/1993 | Japan | 312/238 |

*Primary Examiner*—Peter M. Cuomo
*Assistant Examiner*—Gerald A. Anderson
*Attorney, Agent, or Firm*—John R. Flanagan

[57] ABSTRACT

A corner cabinet drawer assembly includes a corner cabinet frame defining an interior cavity having a front corner opening, at least one central drawer and a pair of side drawers for holding articles with the side drawers disposed on opposite sides of the central drawer, and a plurality of tracks mounting the central and side drawers to the frame to undergo extension and retraction movement from and into the interior cavity with the central drawer moving along a path substantially bisecting the corner cabinet frame and each side drawer moving along a path extending substantially at a 90 degree angle relative to one another and a 45 degree angle relative to the path of movement of the central drawer such that the central and side drawers are extendable through the same front corner opening at separate times. The central drawer has a pair of convergent forward portions for permitting extension and retraction movement of each opposite side drawer when the central drawer is retracted within the interior cavity of the corner cabinet frame. Each side drawer likewise has an angled inside forward portion for permitting extension and retraction movement of the central drawer when each side drawer is retracted within the interior cavity of the corner cabinet frame.

26 Claims, 2 Drawing Sheets

FIG. 1
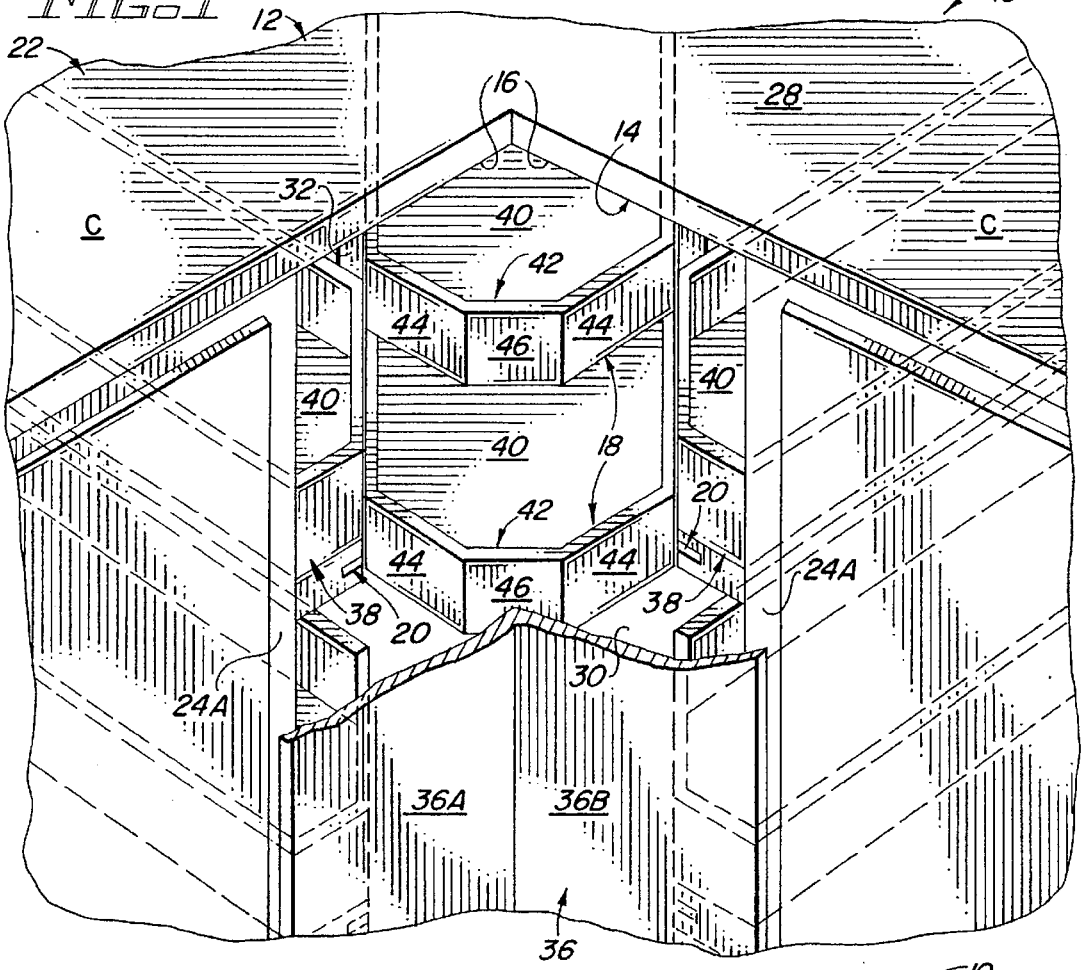
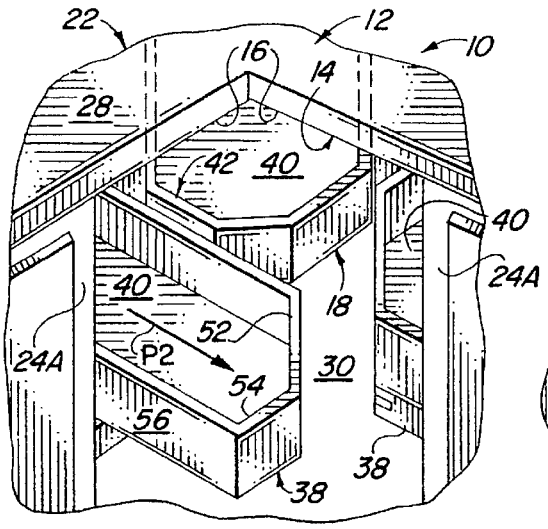
FIG. 2
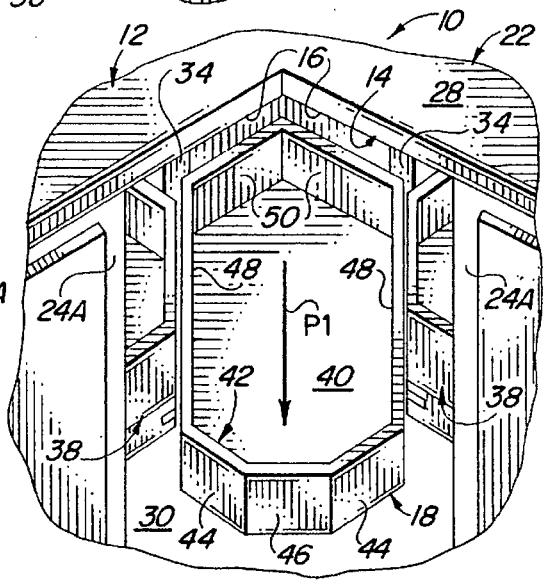
FIG. 3

CORNER CABINET DRAWER ASSEMBLY

BACKGROUND OF THE INVENTION

1. Field of the Invention

The present invention generally relates to cabinets and other furniture items for corners of rooms and, more particularly, is concerned with a corner cabinet drawer assembly.

2. Description of the Prior Art

It is often desirable to utilize every portion of a room including corners thereof. Cabinets and other like furniture assemblies (hereinafter referred to as corner cabinets) may be positioned in room corners. The shelves within corner cabinets are typically fixed or rotatable but are difficult to access because of undue bending and reaching in required of a user. A variety of corner cabinets have therefore been developed over the years in an attempt to make use of room corners and at the same time to alleviate this difficulty often associated with them.

Representative examples of these prior art corner cabinets are disclosed in U.S. Pat. No. 799,253 to Nichols, U.S. Pat. No. 1,764,229 to Smith, U.S. Pat. No. 2,386,092 to Cornish, U.S. Pat. No. 2,627,863 to Cavicchioli, U.S. Pat. No. 2,678,866 to Merrett, U.S. Pat. No. 2,703,267 to Purdy, U.S. Pat. No. 2,941,659 to Thrower et al. and U.S. Pat. No. 4,582,372 to Cooper. A problem exists, however, with these prior art corner cabinets in that none of them provides a convenient, user-friendly solution for accessing cabinets in room corners.

Consequently, a need still exists for a corner cabinet assembly which overcomes the aforementioned problem in the prior art without introducing any new problems in place thereof.

SUMMARY OF THE INVENTION

The present invention provides a corner cabinet drawer assembly designed to satisfy the aforementioned need. The corner cabinet drawer assembly of the present invention provides a convenient, user-friendly solution for accessing cabinets in room corners. The assembly generally provides a plurality of drawers each having a shape adapted to accommodate movement of other drawers substantially on the same level within the cabinet into the same space and front corner opening of the cabinet when the respective drawers are extended at separate times. The assembly has a design which eliminates the undue bending and reaching in often required of a user of prior art corner cabinets.

Accordingly, the present invention is directed to a corner cabinet drawer assembly which comprises: (a) a corner cabinet frame defining an interior cavity having a front corner opening; (b) at least one central platform for holding articles; and (c) at least a pair of track means for mounting the central platform to undergo extension and retraction movement from and into the interior cavity of the corner cabinet frame through the front corner opening and along a path substantially bisecting the corner cabinet frame.

More particularly, the corner cabinet frame defines a housing having a pair of side walls, a pair of adjacent back walls, a floor and a counter top spaced above the floor and forming a ceiling of the housing. The side walls, back walls, floor and counter top together define the interior cavity having the front corner opening.

Furthermore, the assembly preferably has a pair of side platforms for holding articles and being disposed along opposite sides of the central platform. The central and side platforms are preferably central and side drawers respectively with each drawer having a planar base and a continuous sidewall rising substantially perpendicular thereto and from a periphery thereof. The continuous sidewall of the central drawer preferably has a pair of convergent forward portions for permitting the extension and retraction movement of each of the opposite side drawers through the front corner opening when the central drawer is in a retracted position within the interior cavity of the housing. The continuous sidewall of each side drawer likewise preferably has an angled inside forward portion for permitting the extension and retraction movement of the central drawer through the front corner opening when each of the side drawers is in a retracted position within the interior cavity of the housing.

Finally, the assembly has at least a pair of track means for the central drawer and preferably has a pair of track means for each of the side drawers. The track means permits movement of the central drawer along a path which substantially bisects the corner cabinet frame and permits movement of each of the side drawers along a path which is substantially at a 90 degree angle relative to one another and at a 45 degree angle relative to the path of movement of the central drawer.

The assembly also preferably has a pair of the above-described central platforms each being disposed at a different level within the interior cavity of the housing and each being located directly above or below the other. The assembly also preferably has a pair of side platforms disposed along opposite sides of each central platform at each level within the interior cavity.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of a corner cabinet drawer assembly of the present invention.

FIG. 2 is a perspective view of the assembly on a reduced scale relative to FIG. 1 and showing a side drawer in an extended position relative to other drawers in the assembly.

FIG. 3 is a perspective view of the assembly on a reduced scale relative to FIG. 1 and showing a central drawer in an extended position relative to other drawers in the assembly.

DETAILED DESCRIPTION OF THE INVENTION

Figure 4:
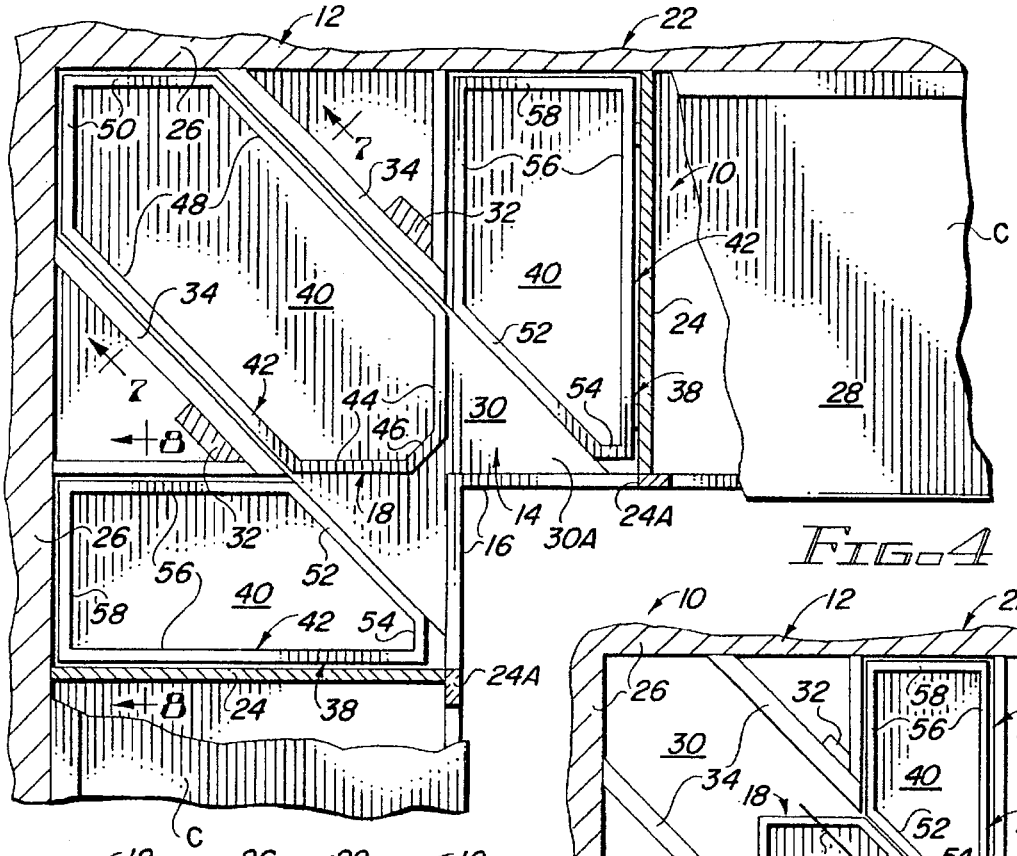
FIG. 4 is a top plan view of the assembly on a reduced scale relative to FIG. 1.

Referring to the drawings and particularly to FIG. 1, there is illustrated a corner cabinet drawer assembly, generally designated 10, of the present invention. Basically, the corner cabinet drawer assembly 10 includes a corner cabinet frame 12 defining an interior cavity 14 having a front corner opening 16, one or more central platforms 18 for holding articles (not shown), and one or more pairs of track means 20 for mounting the respective central platforms 18 to the frame 12 to undergo extension and retraction movement from and into the interior cavity 14 of the frame 12 through the front corner opening 16 and linearly along a path P1 as indicated by the arrows shown in FIGS. 3 and 5 which substantially bisects the frame 12. As seen in FIG. 1, the central platforms 18 are disposed at a different level within the interior cavity 14 of the housing 22, each being located directly above or below the other.

The corner cabinet frame 12 particularly defines a housing 22 having a pair of generally vertical side walls 24, a pair of generally vertical back walls 26 adjacent to one another and to the side walls 24, a counter top 28 which forms a ceiling of the housing 22, and a floor 30. The side walls 24, back walls 26, counter top 28 and floor 30 are interconnected together so as to define the interior cavity 14 having the front corner opening 16. The housing 22 further has a substantially rectangular form in a horizontal plane or cross-section. The side walls 24 and the adjacent back walls 26 are all interconnected and disposed in substantially perpendicular relation to one another and together would substantially form a square in a horizontal plane or cross-section if it were not for the existence of the front corner opening 16 which shortens the length of each of the side walls 24 to an equal extent relative to the length of each of the adjacent back walls 26. The counter top 28 and the floor 30 each have substantially the same amount of surface area and the same substantially rectangular shape except for a missing front corner portion which provides for the front corner opening 16. Both the counter top 28 and the floor 30 may extend beyond the perimeter of the housing 22 as part of adjacent cabinets C. The corner cabinet frame 12 may further define housings having a variety of alternative forms and sizes without departing from the scope of the invention.

The housing 22 also has a pair of vertical posts 32 which support the counter top 28 and are disposed between the counter top 28 and the floor (not shown) of the room and which typically extend through the floor 30 of the housing 22. The vertical posts 32 preferably although not necessarily are substantially rectangular in cross-section and may be fabricated from conventional two-by-four wood boards. The vertical posts 32 are preferably disposed on opposite sides of the central platforms 18. The housing 22 further has at least one pair of horizontal posts 34 disposed between and mounted to the side walls 24 and the back walls 26 and being mounted therebetween to opposite facing sides of the vertical posts 32. Each of the horizontal posts 34 preferably although not necessarily is substantially rectangular in cross-section and may be fabricated from conventional two-by-four wood boards also. The horizontal posts 34 are part of the track means 20 for slidably mounting the central platform 18 within the interior cavity 14 of the housing 22.

The housing 22 further has a front door 36 for covering the front corner opening 16. The front door 36 has a pair of adjacent panel portions 36A, 36B attached together in substantially perpendicular relation to one another and overlying the front corner opening 16 of the housing 22 when the front door 36 is in a closed position, as shown in FIG. 1. The front door 36 is pivotally movable away from the front corner opening 16 to an opened position exposing the interior cavity 14 of the housing 22 to the external environment through the front corner opening 16. Each adjacent portion 36A, 36B of the front door 36 extends between a front edge 28A of the counter top 28 and a front edge 30A of the floor 30. A first of the adjacent portions 36A, 36B can be affixed by a hinge (not shown) to a front edge 24A of one of the side walls 24 and a second of the adjacent portions 36A, 36B releasably attachable to a front edge 24A of the opposite side wall 24. The front door 36 may further be of any other suitable form for covering the front corner opening 16 of the housing 22.

Referring now to FIGS. 1 to 8, the assembly 10 preferably has one or more pairs of side platforms 38 disposed on opposite sides of the respective central platforms 18 at the respective different levels within the interior cavity 14 of the housing 22 with one pair being located directly above or below the other pair. The central platforms 18 and side platforms 38 preferably are central drawers 18 and side drawers 38. Each of the drawers 18, 38 includes a planar base 40 and a continuous sidewall 42 rising substantially perpendicular thereto and from a periphery thereof. The number and form of the platforms or drawers 18, 38 may be varied as desired without departing from the scope of the invention.

The continuous sidewall 42 of each central drawer 18 preferably has a pair of convergent forward portions 44, a straight forward portion 46 disposed between the pair of convergent forward portions 44, a pair of opposite side portions 48 in substantially perpendicular relation to the straight forward portion 46 and in substantially parallel relation to one another and a pair of convergent rear portions 50 which meet at a rear point and do not have a straight portion therebetween. As readily seen in FIGS. 2, 4 and 6, the convergent forward portions 44 of the central drawer 18 permit extension and retraction movement of each of the respective opposite side drawers 38 through the front corner opening 16 when the central drawers 18 is in a retracted position within the interior cavity 14 of the housing 22.

Figure 5:
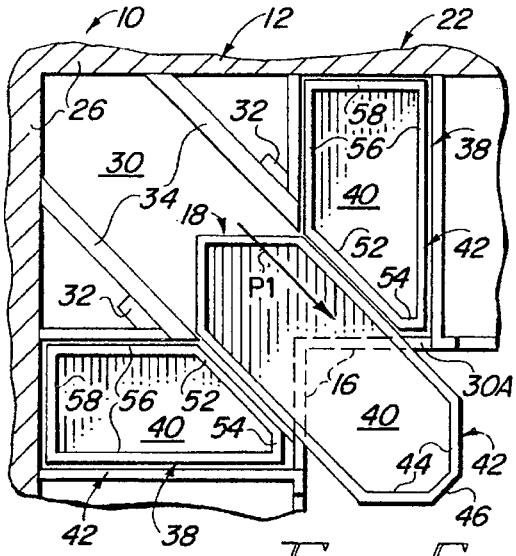
FIG. 5 is a top plan view of the assembly on a reduced scale relative to FIG. 4 and showing a central drawer in an extended position relative to other drawers in the assembly.
Figure 6:
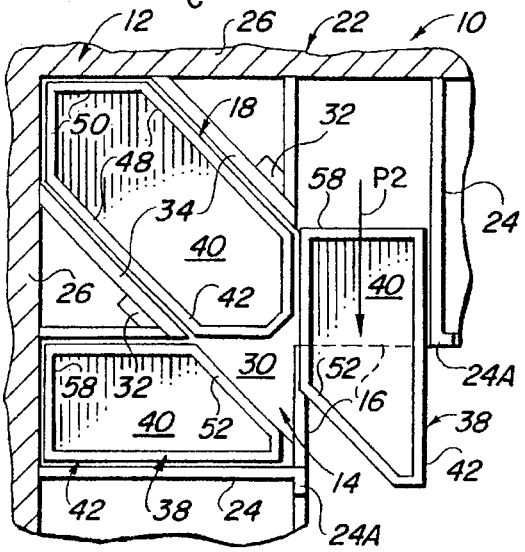
FIG. 6 is a top plan view of the assembly on a reduced scale relative to FIG. 4 and showing a side drawer in an extended position relative to other drawers in the assembly.
Figure 8:
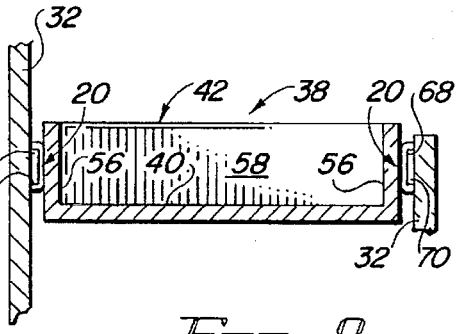
FIG. 8 is an enlarged cross-sectional view of the assembly taken along line 8—8 of FIG. 4.
Figure 7:
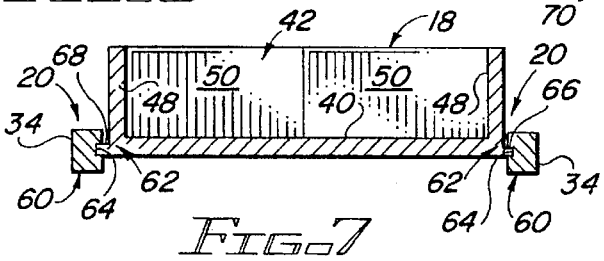
FIG. 7 is an enlarged cross-sectional view of the assembly taken along line 7—7 of FIG. 4.

The continuous sidewall 42 of each side drawer 38 likewise preferably has an angled inside forward portion 52, a straight forward portion 54, a pair of opposite side portions 56 and a straight rear portion 58. The straight forward and rear portions 54, 58 are in substantially parallel relation to one another and in substantially perpendicular relation to the opposite side portions 56. The opposite side portion 56 which is connected to the angled inside forward portion 52 has a length less than that of the other opposite side portion 56. As seen in FIGS. 3 and 5, the angled inside forward portion 52 of each side drawer 38 permits extension and retraction movement of the central drawer 18 through the front corner opening 16 when the side drawers 38 are in retracted positions within the interior cavity 14 of the housing 22. The continuous sidewall 42 of each central and side drawer 18, 38 may alternatively have any other suitable form.

The assembly 10 also has one pair of track means 20 for supporting each of the central drawers 18 and one pair of track means 20 for supporting each of the side drawers 38 at the different levels within the interior cavity 14 of the housing 22. The respective track means 20 permits movement of the central drawer 18 along the path P1 as indicated by the arrows shown in FIGS. 3 and 5 which substantially bisects the corner cabinet frame 12 and permits movement of each of the side drawers 38 along a path P2 as indicated by the arrows shown in FIGS. 2 and 6. Each side drawer 38 moves along the path P2 substantially at a 90 degree angle relative to one another and along the path P1 substantially at a 45 degree angle relative to the path P1 of movement of the central drawer 18 such that the central drawer 18 and side drawers 38 are each extendable through the front corner opening 16 at separate times.

The track means 20 for each central drawer 18 includes first members 60 mounted to the corner cabinet frame 12 and second members 62 mounted to the central drawer 18 and slidably interfitting with the first members 60 for mounting the central drawer 18 to the corner cabinet frame 12 and for guiding retraction and extension movement of the central drawer 18 along the first members 60 relative to the frame 12. Each first member 60 of the track means 20 is preferably a groove 64, as shown particularly in FIG. 7, generally defined in the corner cabinet frame 12 and particularly defined in each horizontal post 34. Each second member 62 of the track means 20 is preferably a ledge 66, as shown particularly in FIG. 7, defined on one of a pair of opposite edges of the central drawer 18 extending along the exterior of each of the opposite side portions 48 of the continuous sidewall 42 thereof and having a shape complementary to that of the groove 64 for insertion of the ledge 66 into the groove 64 to slidably mount the central drawer 18 to the frame 12. The groove 64 generally extends the full length of the horizontal post 34.

The track means 20 for each side drawer 38 has extension and retraction members 68, 70 respectively mounted to the corner cabinet frame 12 and to the side drawer 38 and slidably interfitting with one another for mounting the side drawer 38 to the frame 12 and for guiding retraction and extension movement of the side drawer 38 along the track means 20 relative to the frame 12. A first of the extension and retraction members 68, 70 is preferably attached to a side wall 24 and a second of the extension and retraction members 68, 70 is preferably attached to the exterior of the longer of the opposite side portions 56 of the side drawer 38. In addition, a first of the extension and retraction members 68, 70 may also be attached to a vertical post 32 and a second of the extension and retraction members 68, 70 may also be attached to the exterior of the shorter of the opposite side portions 56 of the side drawer 38. The extension and retraction members 68, 70 are generally complementary attachments which permit linear movement of one object relative to another and are particularly complementary longitudinal channel members fastened to the side wall 24 and to the exterior of the longer of the opposite side portions 56 of the side drawer 38 which permit linear movement of the side drawer 38 relative to the corner cabinet frame 12.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A corner cabinet drawer assembly, comprising:

(a) a corner cabinet frame defining an interior cavity having a front corner opening;

(b) at least one central platform for holding articles;

(c) at least one side platform for holding articles and being disposed along one side of said central platform; and (d) a plurality of track means for mounting said central platform and said side platform to said corner cabinet frame to undergo extension and retraction movement from and into said interior cavity of said corner cabinet frame with said central platform moving along a path substantially bisecting said corner cabinet frame and said side platform moving along a path extending substantially at an acute angle relative to said path of movement of said central platform such that said central platform and side platform are extendable through said front corner opening at separate times;

(e) wherein said central and side platforms are respective central and side drawers each having a planar base and a continuous sidewall rising substantially perpendicular thereto and from a periphery thereof and wherein said continuous sidewall of said side drawer has an angled inside forward portion for permitting extension and retraction movement of said central drawer through said front corner opening of said corner cabinet frame when said side drawer is retracted within said interior cavity of said corner cabinet frame.

2. The assembly of claim 1 wherein said corner cabinet frame defines a housing having a pair of side walls, a pair of adjacent back walls, a floor and a counter top spaced above said floor and forming a ceiling of said housing, said side walls, back walls, floor and counter top together defining said interior cavity having said front corner opening.

3. The assembly of claim 1 wherein said continuous sidewall of said central drawer has a pair of convergent forward portions for permitting extension and retraction movement of said side drawer through said front corner opening of said corner cabinet frame when said central drawer is retracted within said interior cavity of said corner cabinet frame.

4. The assembly of claim 1 wherein said track means includes first members mounted to said corner cabinet frame and second members mounted to said central platform and slidably interfitting with said first members for mounting said central platform to said corner cabinet frame and for guiding retraction and extension movement of said central platform along said track means relative to said corner cabinet frame.

5. The assembly of claim 4 wherein each of said first members of said track means includes a groove defined in said corner cabinet frame.

6. The assembly of claim 5 wherein each of said second members of said track means includes a ledge defined on one of a pair of opposite edges of said central platform and having a shape complementary to that of said groove in said corner cabinet frame for insertion of said ledge into said groove to slidably mount said central platform to said corner cabinet frame.

7. The assembly of claim 1 wherein said track means further includes extension and retraction members respectively mounted to said corner cabinet frame and to said side platform and slidably interfitting with one another for mounting said side platform to said corner cabinet frame and for guiding retraction and extension movement of said side platform along said track means relative to said corner cabinet frame.

8. A corner cabinet drawer assembly, comprising:

(a) a corner cabinet frame defining an interior cavity having a front corner opening;

(b) at least one central platform for holding articles;

(c) at least one side platform for holding articles and being disposed along one side of said central platform; and (d) a plurality of track means for mounting said central platform and said side platform to said corner cabinet frame to undergo extension and retraction movement from and into said interior cavity of said corner cabinet frame with said central platform moving along a path substantially bisecting said corner cabinet frame and said side platform moving along a path extending substantially at an acute angle relative to said path of movement of said central platform such that said central platform and side platform are extendable through said front corner opening at separate times;

(e) wherein said central and side platforms are respective central and side drawers each having a planar base and a continuous sidewall rising substantially perpendicular thereto and from a periphery thereof and wherein said continuous sidewall of said central drawer has a pair of convergent forward portions for permitting extension and retraction movement of said side drawer through said front corner opening of said corner cabinet frame when said central drawer is retracted within said interior cavity of said corner cabinet frame.

9. The assembly of claim 8 wherein said corner cabinet frame defines a housing having a pair of side walls, a pair of adjacent back walls, a floor and a counter top spaced above said floor and forming a ceiling of said housing, said side walls, back walls, floor and counter top together defining said interior cavity having said front corner opening.

10. The assembly of claim 8 wherein said track means further includes extension and retraction members respectively mounted to said corner cabinet frame and to said side platform and slidably interfitting with one another for mounting said side platform to said corner cabinet frame and for guiding retraction and extension movement of said side platform along said track means relative to said corner cabinet frame.

11. The assembly of claim 8 wherein said track means includes first members mounted to said corner cabinet frame and second members mounted to said central platform and slidably interfitting with said first members for mounting said central platform to said corner cabinet frame and for guiding retraction and extension movement of said central platform along said track means relative to said corner cabinet frame.

12. The assembly of claim 11 wherein each of said first members of said track means includes a groove defined in said corner cabinet frame.

13. The assembly of claim 12 wherein each of said second members of said track means includes a ledge defined on one of a pair of opposite edges of said central platform and having a shape complementary to that of said groove in said corner cabinet frame for insertion of said ledge into said groove to slidably mount said central platform to said corner cabinet frame.

14. A corner cabinet drawer assembly, comprising:

(a) a corner cabinet frame defining an interior cavity having a front corner opening;

(b) at least one central platform for holding articles;

(c) at least a pair of side platforms for holding articles and being disposed along opposite sides of said central platform; and (d) a plurality of track means for mounting said central platform and said side platforms to said corner cabinet frame to undergo extension and retraction movement from and into said interior cavity of said corner cabinet frame with said central platform moving along a path substantially bisecting said corner cabinet frame and each of said side platforms moving along a path substantially at a 90 degree angle relative to one another and along a path substantially at a 45 degree angle relative to said path of movement of said central platform such that said central platform and side platforms are extendable through said front corner opening at separate times;

(e) wherein said central and side platforms are respective central and side drawers each having a planar base and a continuous sidewall rising substantially perpendicular thereto and from a periphery thereof and wherein said continuous sidewall of said central drawer has a pair of convergent forward portions for permitting extension and retraction movement of said side drawers through said front corner opening of said corner cabinet frame when said central drawer is retracted within said interior cavity of said corner cabinet frame.

15. The assembly of claim 14 wherein said track means includes first members mounted to said corner cabinet frame and second members mounted to said central platform and slidably interfitting with said first members for mounting said central platform to said corner cabinet frame and for guiding retraction and extension movement of said central platform along said track means relative to said corner cabinet frame.

16. The assembly of claim 15 wherein each of said first members of said track means includes a groove defined in said corner cabinet frame.

17. The assembly of claim 16 wherein each of said second members of said track means includes a ledge defined on one of a pair of opposite edges of said central platform and having a shape complementary to that of said groove in said corner cabinet frame for insertion of said ledge into said groove to slidably mount said central platform to said corner cabinet frame.

18. The assembly of claim 14 wherein said track means further has extension and retraction members mounted to said corner cabinet frame and to each of said side platforms and slidably interfitting with one another for mounting said side platforms to said corner cabinet frame and for guiding retraction and extension movement of each of said side platforms along said track means relative to said corner cabinet frame.

19. The assembly of claim 14 wherein said corner cabinet frame defines a housing having a pair of side walls, a pair of adjacent back walls, floor and a counter top spaced above said floor and forming a ceiling of said housing, said side walls, back walls, floor and counter top together defining said interior cavity having said front corner opening.

20. A corner cabinet drawer assembly, comprising:

(a) a corner cabinet frame defining an interior cavity having a front corner opening;

(b) at least one central platform for holding articles;

(c) at least a pair of side platforms for holding articles and being disposed along opposite sides of said central platform; and (d) a plurality of track means for mounting said central platform and said side platforms to said corner cabinet frame to undergo extension and retraction movement from and into said interior cavity of said corner cabinet frame with said central platform moving along a path substantially bisecting said corner cabinet frame and each of said side platforms moving along a path substantially at a 90 degree angle relative to one another and along a path substantially at a 45 degree angle relative to said path of movement of said central platform such that said central platform and side platforms are extendable through said front corner opening at separate times;

(e) wherein said central and side platforms are respective central and side drawers each having a planar base and a continuous sidewall rising substantially perpendicular thereto and from a periphery thereof and wherein said continuous sidewall of each of said side drawers has an angled inside forward portion for permitting extension and retraction movement of said central drawer through said front corner opening of said corner cabinet frame when each of said side drawers is retracted within said interior cavity of said corner cabinet frame.

21. The assembly of claim 20 wherein said continuous sidewall of said central drawer has a pair of convergent forward portions for permitting extension and retraction movement of said side drawers through said front corner opening of said corner cabinet frame when said central drawer is retracted within said interior cavity of said corner cabinet frame.

22. The assembly of claim 20 wherein said track means includes first members mounted to said corner cabinet frame and second members mounted to said central platform and slidably interfitting with said first members for mounting said central platform to said corner cabinet frame and for guiding retraction and extension movement of said central platform along said track means relative to said corner cabinet frame.

23. The assembly of claim 22 wherein each of said first members of said track means includes a groove defined in said corner cabinet frame.

24. The assembly of claim 23 wherein each of said second members of said track means includes a ledge defined on one of a pair of opposite edges of said central platform and having a shape complementary to that of said groove in said corner cabinet frame for insertion of said ledge into said groove to slidably mount said central platform to said corner cabinet frame.

25. The assembly of claim 20 wherein said track means further has extension and retraction members mounted to said corner cabinet frame and to each of said side platforms and slidably interfitting with one another for mounting said side platforms to said corner cabinet frame and for guiding retraction and extension movement of each of said side platforms along said track means relative to said corner cabinet frame.

26. The assembly of claim 20 wherein said corner cabinet frame defines a housing having a pair of side walls, a pair of adjacent back walls, floor and a counter top spaced above said floor and forming a ceiling of said housing, said side walls, back walls, floor and counter top together defining said interior cavity having said front corner opening.

* * * * *